US011673009B2

(12) United States Patent
Shoap

(10) Patent No.: US 11,673,009 B2
(45) Date of Patent: Jun. 13, 2023

(54) AUTOMATIC FLUID SPRAY SYSTEMS

(71) Applicant: Stephen D. Shoap, Wakefield, MA (US)

(72) Inventor: Stephen D. Shoap, Wakefield, MA (US)

( * ) Notice: Subject to any disclaimer, the term of this patent is extended or adjusted under 35 U.S.C. 154(b) by 27 days.

(21) Appl. No.: 17/533,647

(22) Filed: Nov. 23, 2021

(65) Prior Publication Data

US 2022/0161082 A1 May 26, 2022

Related U.S. Application Data

(60) Provisional application No. 63/205,216, filed on Nov. 23, 2020.

(51) Int. Cl.

| | |
|---|---|
| ***A62C 35/68*** | (2006.01) |
| ***A62C 37/40*** | (2006.01) |
| ***A62C 37/36*** | (2006.01) |

(52) U.S. Cl.

CPC ..... *A62C 37/40* (2013.01); *A62C 35/68* (2013.01); *A62C 37/04* (2013.01)

(58) Field of Classification Search

CPC ..... A62C 37/40; A62C 35/68; A62C 37/04; A62C 2/08; A62C 3/0214; A62C 3/0264; A62C 3/0292; B05B 1/3093

See application file for complete search history.

(56) References Cited

U.S. PATENT DOCUMENTS

| | | | | |
|---|---|---|---|---|
| 2,720,838 | A * | 10/1955 | Dahl | F04D 15/0011 417/303 |
| 5,911,362 | A * | 6/1999 | Wood | E01C 19/176 239/1 |
| 6,189,807 | B1 * | 2/2001 | Miller | A01M 7/0089 137/625.22 |
| 9,561,393 | B2 | 2/2017 | Shoap | |
| 2008/0000649 | A1 * | 1/2008 | Guirguis | A62C 3/0214 169/60 |
| 2009/0151961 | A1 * | 6/2009 | Voorhees | A62C 35/58 169/13 |

* cited by examiner

*Primary Examiner* — Tuongminh N Pham

(74) *Attorney, Agent, or Firm* — Hayes Soloway PC

(57) ABSTRACT

An automatic fluid spray system includes a water pump fluidly connected to a water source, a return conduit positioned to allow water exiting the water pump to return to the water source, and a spray line comprising a conduit and a plurality of spray elements. The automatic fluid spray system also has a valve that allows water exiting the water pump to either return to the water source or enter the spray line and one or more temperature sensors in electrical communication with a control circuit. The control circuit is electrically connected to the valve and configured to move the valve to supply water to the spray line when a temperature of at least 150° F. is detected by the one or more temperature sensors.

17 Claims, 4 Drawing Sheets

AUTOMATIC FLUID SPRAY SYSTEMS

CROSS REFERENCE TO RELATED APPLICATIONS

This application claims the benefit of U.S. Provisional Application Ser. No. 63/205,216, entitled "Low Cost Automatic Spray System" filed Nov. 23, 2020 and U.S. Provisional Application Ser. No. 63/205,616, entitled "Low Cost Automatic Spray System with Pressure Relief Valve" filed Dec. 29, 2020, the entire disclosures of which are incorporated herein by reference.

FIELD OF THE DISCLOSURE

The present disclosure is generally related to fluid spray systems for protecting structures from fire damage, along with related methods.

BACKGROUND OF THE DISCLOSURE

Homes and other structures can suffer significant damage or destruction from wildfires. As discussed below, currently available systems designed to protect structures from wildfire damage are inadequate.

One conventional method of stopping a grassfire or a wildfire is to create a fire break, a gap in vegetation or other combustible material that acts as a barrier to slow or stop the progress of a bushfire or wildfire. However, fires often create winds that blow embers through the air over long distances and across fire breaks. A fire break can be easily jumped by blowing embers, leaving structures vulnerable to ignition from these embers.

Within the industry, some conventional devices are available to help prevent blowing embers moving past a fire break. One such device, called a water curtain, uses a conventional hose that has many simple holes that are placed close together along the length of the hose. As water is pumped through the hose, it exits each hole and is directed straight up in a vertical column. The resulting overall spray shape is that of a thin curtain, in that, the spraying water is positioned along the length of the hose, but it is only a very thin wall of water. These water curtains are rarely used because they are too thin to significantly reduce radiant heat from a fire, and because the available water is better used to wet the nearby fuels to prevent their ignition.

One technique to protect a structure, such as a building, from a wildfire is to place permanent sprinklers on the roofs or walls of the structures. However, this equipment needs to be manually activated, which is problematic for situations in which evacuation has been ordered. If a homeowner happens to have a spray system available and starts the spray system before leaving, the water supply can quickly be depleted before the fire arrives. Water sprayed before the fire arrives can have some value in wetting the ground and walls of the home, but is not an efficient use of fluid. Thus, a heretofore unaddressed need exists in the industry to address the aforementioned deficiencies and inadequacies in current firefighting technologies.

SUMMARY

The present disclosure, and embodiments provided herein, discloses systems for protecting homes and other structures from wildfires. The disclosed automatic fluid spray systems include a water pump fluidly connected to a water source, a return conduit positioned to allow water exiting the water pump to return to the water source, and a spray line comprising a conduit and a plurality of spray elements. The automatic fluid spray systems have a valve that allows water exiting the water pump to either return to the water source or enter the spray line and one or more temperature sensors in electrical communication with a control circuit. The control circuit is electrically connected to the valve and is configured to move the valve to supply water to the spray line when a preselected temperature is detected by the one or more temperature sensors.

The valve has a first position and a second position and when the valve is in the first position, fluid passes through the valve into the return conduit and not into the spray line, and when the valve is in the second position, fluid passes through the valve into the spray line and not into the return conduit. The automatic fluid spray system can be started by a homeowner before evacuating a site. The system is started by turning on the water pump while the valve is in a position to permit water to return to the water source but not enter the spray line. The system then runs for a period of time without dispensing water and, when the temperature sensors detect that the fire is approaching or has arrived, the valve is automatically turned by the system to divert water to the spray line, which releases water onto the house or other structure.

The valve may be an electric two-port valve. In some such embodiments, the system may also include a variable pressure relief valve in the return conduit that prevents water flow from the water pump to the water source when a pressure drop is detected. In some alternative embodiments, the valve may be an electric three-port valve. The system may, in some embodiments, include a low water detector in the water source to detect when the water source has a low water level, and the control circuit may be configured to move the valve to provide water to the return conduit when a low water level is detected in the water source. If the pump does not have water flowing through it, the pump can overheat and be damaged. The system may also include one or more additional spray lines, and, if present, each additional spray line may be independently controlled by a valve.

DETAILED DESCRIPTION

The present disclosure and figures are directed toward automatic fluid spray systems and related methods. The automatic fluid spray systems include a water pump connected to a water source, a return conduit positioned to allow water exiting the water pump to return to the water source, and a spray line comprising a conduit and a plurality of spray elements. The systems have a valve that allows water exiting the water pump to either return to the water source or enter the spray line and the systems are configured to move the valve to supply water to the spray line when a given temperature threshold is detected. The automatic spray systems can be started by a homeowner before evacuating a site. The system runs for a period of time without dispensing water and, when temperature sensors detect that the fire is approaching or has arrived, the valve is automatically turned by the system to divert water to the spray line, which releases water onto the house or other structure. The presently disclosed systems and methods advantageously allow for the system to be started prior to evacuation but not waste fluids before the fire arrives. The disclosed automatic fluid spray systems are inexpensive, easy to use, and efficiently dispense fluids to minimize wildfire damage to homes or other structures.

Figure 1:
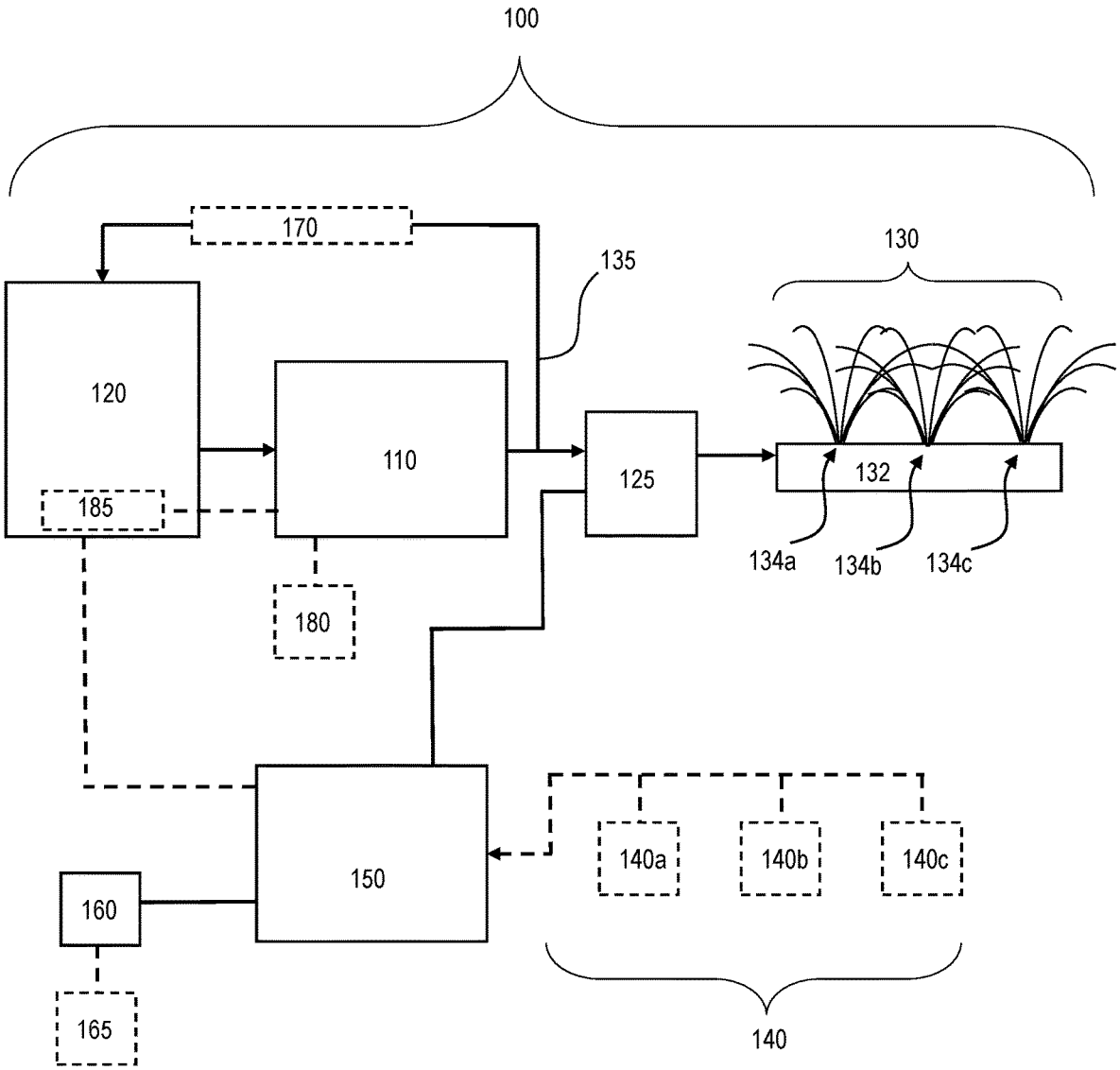
FIG. 1 is an illustration of a plan view of an exemplary automatic fluid spray system having a two-port valve, configured in accordance with some embodiments of the subject disclosure.
Figure 2:
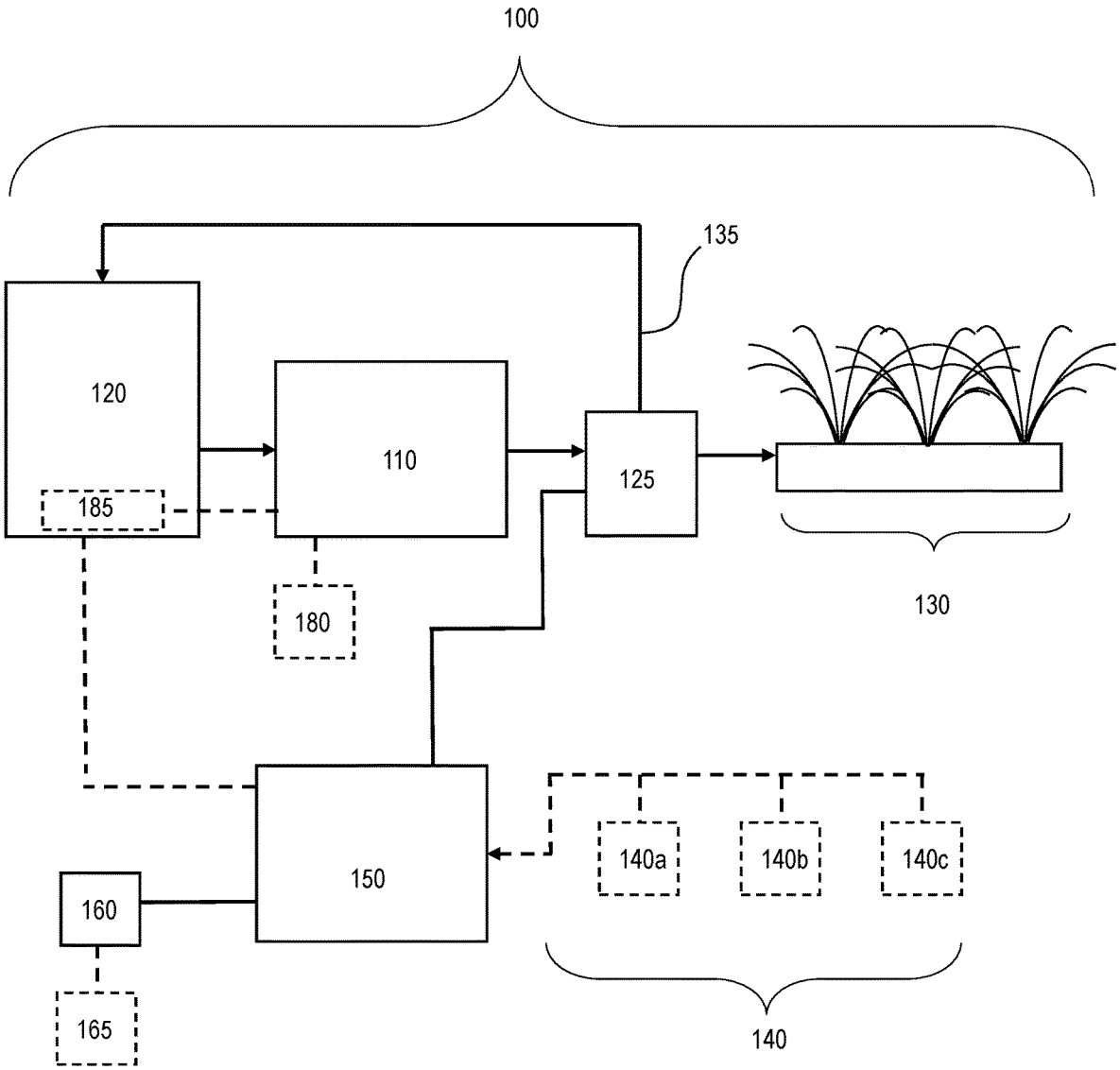
FIG. 2 is an illustration of a plan view of an exemplary automatic fluid spray system having a three-port valve, configured in accordance with some embodiments of the subject disclosure.
Figure 3:
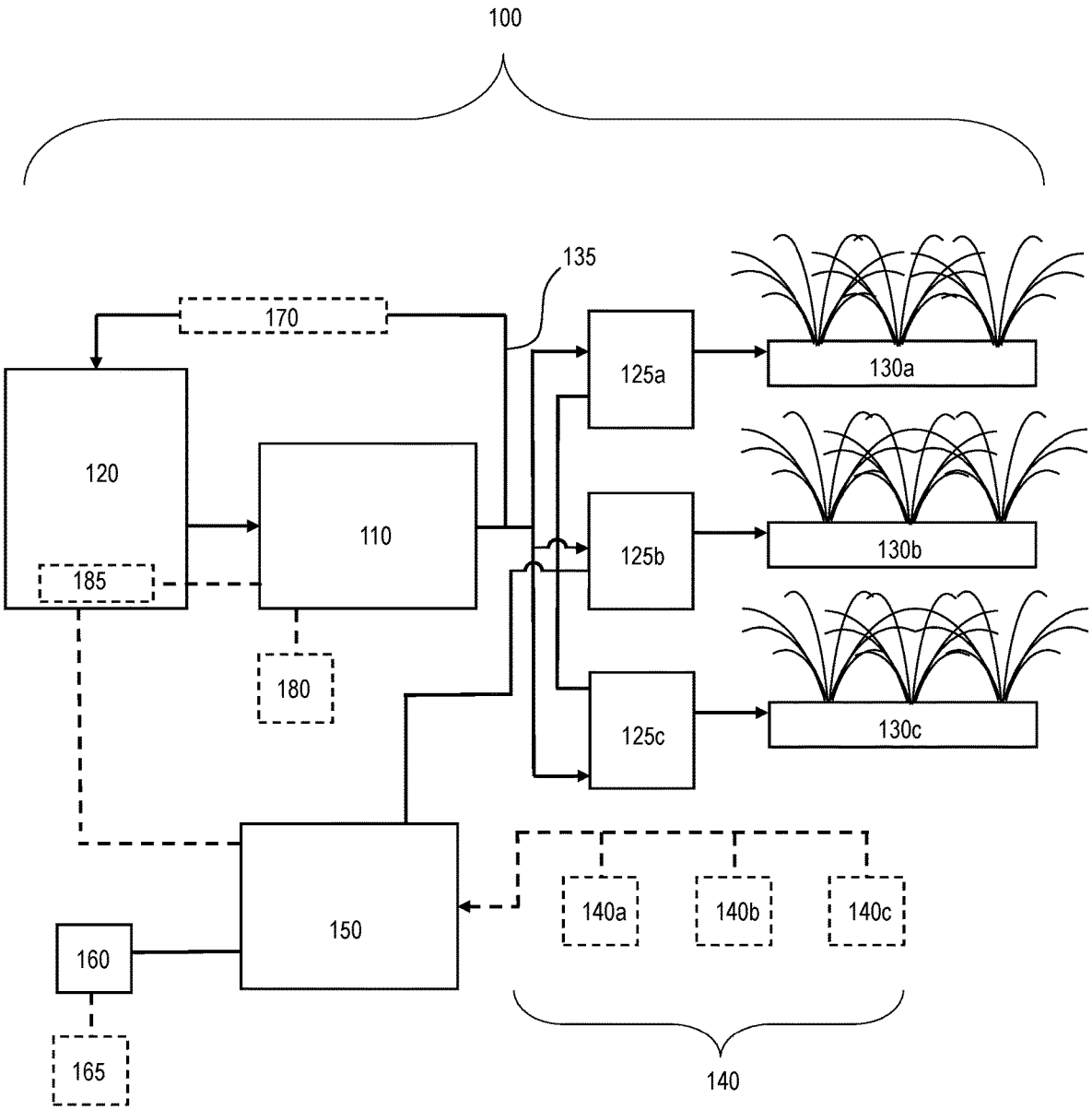
FIG. 3 is an illustration of a plan view of an exemplary automatic fluid spray system having multiple spray lines, configured in accordance with some embodiments of the subject disclosure.

FIGS. 1-3 each illustrate an exemplary automatic fluid spray system 100. FIG. 1 illustrates an automatic fluid spray system 100 having a two-port valve, FIG. 2 illustrates an automatic fluid spray system 100 having a three-port valve, and FIG. 3 illustrates an automatic fluid spray system 100 having multiple spray lines. The automatic fluid spray systems 100 described herein may be generally referred to herein as "fluid spray system," "spray system," and/or simply "system." The automatic fluid spray system 100 may be used to protect the exterior of a home, residential or industrial building, or other type of infrastructure. As described below in detail, the automatic fluid spray system 100 can be armed before a fire arrives to allow for human evacuation of the site as well as timely activation of the fluid spray as the fire arrives. In contrast with fluid spray systems equipped with expensive pumps that have remote activation capability, the presently disclosed systems are much cheaper while still providing sufficient time for evacuation. It should be understood that all dotted lines shown in the accompanying figures illustrate optional components and connections.

The automatic fluid spray system 100 shown in FIGS. 1-3 includes a water pump 110 in fluid connection with a water source 120 and configured to receive water from the water source 120. The water pump 110 can be a gasoline, diesel, or other type fossil fuel-powered water pump. Any type of available water source 120 can be used in system 100, including a tank, pool, or cistern. In some embodiments in which a gasoline-powered water pump 110 is used, the choke and throttle of the water pump 110 may be automatically adjusted by a computer chip and/or small motor equipment.

Water from the water pump 110 feeds into a valve 125. The valve 125 allows water exiting the water pump 110 to either return to the water source 120 (via the return conduit 135) or enter the spray line 130. The valve 125 has a first position and a second position and when the valve 125 is in the first position, fluid passes through the valve 125 into the return conduit 135 and not into the spray line 130, and when the valve 125 is in the second position, fluid passes through the valve 125 into the spray line 135 and not into the return conduit 135.

The valve 125 is an electric two-port valve. In other embodiments, however, the valve 125 may be an electric three-port valve. The valve 125 shown in FIG. 1 is a two-port valve and the valve 125 shown in FIG. 2 is a three-port valve. The two-port valve 125 shown in FIG. 1 has a closed position and an open position and when the valve 125 is in the closed position, no fluid can pass through the valve 125 into the spray line 130 and when the valve 125 is in the open position, fluid passes through the valve 130 into the spray line 130. It should be understood that valve 125 may be implemented with any desired type of valve. For example, in some embodiments, valve 125 may operate in only an open position or a closed position. However, in other embodiments, valve 125 may be a ball valve and may operate in states between fully open and fully closed. Numerous valve configurations are possible and contemplated herein.

The spray line 130 supplies water to the home or other structure. Various types of conduits can be used in connection with spray line 130. For example, in some embodiments, a spray hose as disclosed in U.S. Pat. No. 9,561,393 (Shoap) may be used for some or all of spray line 130. In some embodiments, spray line 130 comprises a conduit 132 and a plurality of spray elements 134*a*, 134*b*, 134*c*, as shown in FIG. 1. Spray line 130 may have any number of spray elements, such as at least two, three, four, five, ten, fifteen, twenty, or more spray elements. Spray line 130 can be positioned as desired to protect a home or other structure. For example, spray elements 134*a*, 134*b*, 134*c* can be positioned on the exterior of a home or other structure and arranged to wet the structure to protect it from approaching fires.

Valve 125 may be a two-port valve (as shown in FIG. 1) or a three-port valve (as shown in FIG. 2). In some embodiments, valve 125 may be an electric valve. Valve 125 is controlled by a control circuit 150. Control circuit 150 may be configured to open the valve 125 after a certain period of time has passed after the system 100 has been activated. In other embodiments, the control circuit 150 may be in electrical communication with one or more temperature sensors 140 (e.g., sensors 140*a*, 140*b*, 140*c* shown in FIGS. 1-3) and may be configured to open valve 125 if a preselected temperature is detected by the one or more temperature sensors 140. In some embodiments, the preselected temperature is at least 130° F., 140° F., 160° F., or 180° F.

Any suitable type of temperature sensor 140 may be used in system 100, if desired. For example, the one or more temperature sensors 140 may be a thermistor or other type of fire detector. Any number of temperature sensors 140 may be used in connection with the automatic fluid spray system 100. For example, one, two, three, four, five, six, or more than six temperature sensors 140 may be included in the automatic fluid spray system 100. The one or more temperature sensors 140 may be mounted on the outer walls of the home or other structure. If present, the one or more temperature sensors 140 can allow the system 100 to begin spraying fluid at an optimal time, based on when excessive heat is detected from an approaching wildfire. The temperature threshold at which the control circuit 150 opens the valve 125 can be selected such that fluid is deployed from the spray line 130 before the main front of the fire arrives, so that the home or other structure is wetted prior to the arrival of the wildfire, which can prevent burning embers from igniting a fire. The deployed water can also lower radiant energy from a fire, making ignition of the home or structure less likely. In some embodiments, portions of the spray line 130 can also be deployed a substantial distance on the ground away from the house or other structure in order to stop the fire before it gets near the house or structure.

The control circuit 150 may be powered by a battery 160 or other power source. If a battery 160 is used to power the control circuit 150, a float charger 165 connected to house power or solar power may be used. The float charger 165 can ensure that the battery is always fully charged.

As shown in FIGS. 1-3, system 100 includes a return conduit 135 to permit water exiting the water pump 110 to flow back into the water source 120. Due to the unique nature of the circumstances in which system 100 is designed to be used, water pump 110 may be operating for a significant amount of time before valve 125 is opened and water is supplied to the spray line 130. Without water flowing through water pump 110, it could overheat from friction. Providing a return conduit 135 to allow water to flow through water pump 110 while valve 125 is closed, can advantageously prevent the water pump 110 from overheating.

A shown in FIGS. 1 and 3, in some embodiments, a variable pressure relief valve 170 may be included in the return conduit 135 to permit water exiting the water pump 110 to flow back into the water source 120. When the valve 125 is shut, very little water is flowing through the water pump 110 so the pressure measured by the variable pressure relief valve 170 will be relatively high. When the valve 125 is opened, water will flow into spray line 130 and the flow of water through the water pump 110 will greatly increase. In turn, the pressure measured by the variable pressure relief valve 170 will decrease. The variable pressure relief valve 170 can be configured to shut when the pressure drops, thereby allowing all of the water coming out of the water pump 110 to flow directly into the spray line 130. The variable pressure relief valve 170 prevents water flow from the water pump to the water source when a preselected pressure drop occurs.

Since a fire may not arrive for many hours after the water pump 110 is started, it may be desirable to provide the water pump 110 with a large amount of fuel. Therefore, in some embodiments, a large gasoline supply may be provided in the form of an additional gasoline tank 180 connected to the water pump 110, as shown in FIGS. 1-3. A large gasoline supply can allow the water pump 110 to run for many hours and provide additional wildfire protection to the structure.

If desired, a low water detector 185 may be located within the water source 120 and may be configured to detect when the water source 120 has a low water level. As shown in FIGS. 1-3, the low water detector 185, if present, may be electrically connected to the water pump 110 and/or the control circuit 150. In some such embodiments, the low water detector 185 can be configured to turn off the water pump 110 when a low water level in the water source 120 is detected to prevent the water pump 110 from overheating when no water is available to flow through the water pump 110. In select embodiments, the control circuit 150 may be configured to move the valve 125 to provide water to the return conduit 135 when a low water level is detected in the water source 120.

FIG. 2 illustrates an embodiment in which valve 125 of system 100 is a three-port valve. There are two types of three-port valves that can be used for valve 125: an On/Off type, which can either be fully on or fully off, and a throttling type, which allows for continuous flow rates between fully open and fully shut. The three-port valve directs water from the water pump 110 either back to the water source 120 or to the spray line 130. When the system is turned on, valve 125 is positioned to direct water from the water pump 110 back into the water source 120 (not to the spray line 130). When the fire comes close enough to be detected, control circuit 150 automatically moves valve 125 to direct water from the water pump 110 to the spray line 130 instead of the water source 120. Since in the three-port valve embodiment shown in FIG. 2, all the water that goes into valve 125 will go back to the water source 120 or to the spray line 130, there is no need for a variable pressure relief valve 170, as shown in FIGS. 1 and 3.

As previously mentioned, a low water signal detected from the low water detector 185 (if present) can cause the control circuit 150 to move the valve 125 to direct water coming from the water pump 110 back to the water source 120 and not to the spray line 130 to prevent overheating. In embodiments in which valve 125 is a throttling-type of two-port or three-port valve, electric circuits or a microprocessor can be used to set the amount of flow directed to the spray line 130. A minimal flow may be used when the detected temperature is relatively low and when the temperature rises significantly, more water can be supplied to spray line 130. Different water allocation algorithms can be used to ensure efficient use of the available water within the water source 120.

In an alternative design, system 100 may include multiple spray lines that are each independently controlled. FIG. 3 shows an exemplary automatic fluid spray system 100 having a plurality of spray lines 130*a*, 130*b*, 130*c*, each connected to a valve 125*a*, 125*b*, 125*c*. In particular, valve 125*a* controls water flow to spray line 130*a*, valve 125*b* controls water flow to spray line 130*b*, and valve 125*c* control water flow to spray line 130*c*. Thus, system 100 may include at least a first spray line 130*a* controlled by a first valve 125*a*, a second spray line 130*b* controlled by a second valve 125*b*, and a third spray line 130*c* controlled by a third valve 125*c*. In some embodiments, each valve 125*a*, 125*b*, 125*c* is controlled by a separate temperature sensor 140. Valves 125*a*, 125*b*, 125*c* may operate independently, in some embodiments. In some such embodiments, valves 125*a*, 125*b*, 125*c* may each be connected to the control circuit 150 and the control circuit may independently control whether the valves 125*a*, 125*b*, 125*c* are in the open or the closed position. In some embodiments, the valves 125*a*, 125*b*, 125*c* may be two-port electric valves. In these and other embodiments, the valves 125*a*, 125*b*, 125*c* may be ball valves, which allow for use in between fully open and fully closed positions. In select embodiments, temperature measurements from the one or more temperature sensors 140 can be used to direct the flow of water from the valves 125*a*, 125*b*, 125*c*. In this way, water can be strategically deployed in regions with higher temperatures and not wasted in regions where it is not needed. The control circuit 150 may, in some embodiments, contain programming to determine the best allocation of fluid spray between multiple spray lines 130*a*, 130*b*, 130*c* and control the valves 125*a*, 125*b*, 125*c* to execute the determined fluid allocation. Control circuit 150 may be connected to the valves 125*a*, 125*b*, 125*c* with individual wires or, in other embodiments, may be in communication valves 125*a*, 125*b*, 125*c* via a digital network. In some embodiments, the temperature sensors 140 are part of a digital network, and the respective current temperature measurement of each temperature sensor 140 is transmitted to the control circuit 150, and the control circuit 150 uses microcomputer algorithms to determine where water should be sprayed, and how much water should be sprayed. Numerous connection configurations and variations are possible and contemplated herein.

Figure 4:
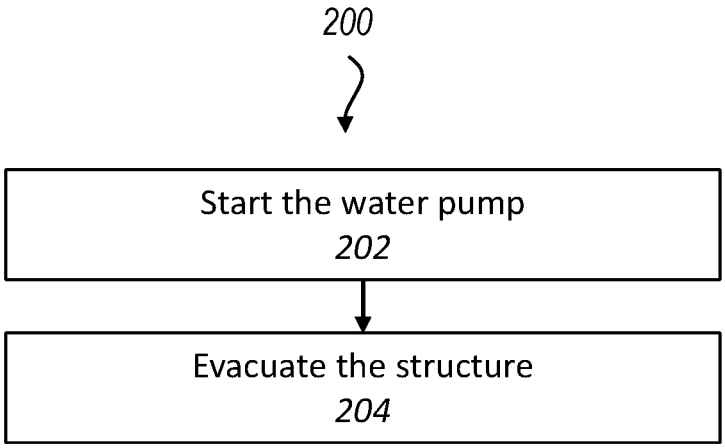
FIG. 4 is an illustration of an exemplary method of using an automatic fluid spray system as described herein.

FIG. 4 illustrates an example method 200 of using the automatic spray system 100 (as previously described herein and as illustrated in any of FIGS. 1-3) to protect a structure from a wildfire. As shown in FIG. 4, method 200 includes starting the water pump 110 (Block 202). In embodiments in which the water pump 110 is a simple and inexpensive gasoline-powered pump, the water pump 110 must be started by manually placing the choke lever in the START position, and manually setting the throttle at a low setting. When the start cord is pulled, the gasoline engine starts, and the choke is manually placed in the RUN position and the throttle is moved to the MAX position. In embodiments in which a low cost diesel water pump is used, similar manual operations are used to start the water pump 110. When the water pump 110 is started, the valve 125 is in a position to permit water to return to the water source 120 but not enter the spray line 130.

Method 200 continues with evacuating the structure (Block 204). After the structure is evacuated, the water pump 110 will continue to run without spraying any water from the spray line 130 until the system 100 detects a temperature above a threshold level. When a temperature above a threshold level is detected, the control circuit 150 will move the valve 125 to supply water to the spray line 130, which will spray the structure. The system 100 will continue to supply water to the spray line 130 until a low water level is detected in the water source 120.

What is claimed is:

1. An automatic fluid spray system comprising:

a water pump fluidly connected to a fluid source and configured to receive fluid from the fluid source;

a return conduit positioned to allow fluid exiting the water pump to return to the fluid source;

a spray line comprising a conduit and a plurality of spray elements;

a valve connected between the water pump and the spray line, wherein the at least one valve in an open position fluidly connects the spray line to the water pump and in a closed position causes all of the fluid pumped through the water pump to the return conduit, thereby allowing fluid exiting the water pump to return directly to the fluid source; and one or more temperature sensors in electrical communication with a control circuit, wherein the control circuit is electrically connected to the valve and configured to move the valve to the open position when a preselected temperature is detected by the one or more temperature sensors.

2. The automatic fluid spray system of claim 1, wherein the valve is an electric two-port valve.

3. The automatic fluid spray system of claim 2, wherein when in the closed position, no fluid can pass through the valve into the spray line and when the valve is in the open position, fluid passes through the valve into the spray line.

4. The automatic fluid spray system of claim 2 further comprising a variable pressure relief valve in the return conduit that prevents fluid flow from the water pump to the fluid source when a preselected pressure is measured in the return conduit.

5. The automatic fluid spray system of claim 1, wherein the valve is an electric three-port valve.

6. The automatic fluid spray system of claim 1, wherein the valve has a first position and a second position and when the valve is in the first position, fluid passes through the valve into the return conduit and not into the spray line, and when the valve is in the second position, fluid passes through the valve into the spray line and not into the return conduit.

7. The automatic fluid spray system of claim 1, wherein the water pump is powered by gasoline.

8. The automatic fluid spray system of claim 1, wherein the fluid source is a tank, a pool, or a cistern.

9. The automatic fluid spray system of claim 1, wherein the one or more temperature sensors are mounted on a house or a building.

10. The automatic fluid spray system of claim 1 further comprising a low fluid detector in the fluid source to detect when the fluid source has a low fluid level, and wherein the control circuit is configured to move the valve to provide fluid to the return conduit when a low fluid level is detected in the fluid source in order to prevent the pump from overheating.

11. The automatic fluid spray system of claim 1 further comprising one or more additional spray lines, wherein each additional spray line is independently controlled by a valve.

12. The automatic fluid spray system of claim 11, wherein each valve is controlled by a separate temperature sensor.

13. The automatic fluid spray system of claim 1, wherein the spray line further comprises at least a first spray line controlled by a first valve, a second spray line controlled by a second valve, and a third spray line controlled by a third valve.

14. The automatic fluid spray system of claim 13, wherein the first valve, the second valve, and the third valve are each two-port electric valves.

15. The automatic fluid spray system of claim 11, wherein the temperature sensors are part of a digital network, and wherein the respective current temperature measurement of each temperature sensor is transmitted to the control circuit, and the control circuit uses microcomputer algorithms to determine where water should be sprayed, and how much water should be sprayed.

16. The automatic fluid spray system of claim 15, where some or all of the valves are ball valves which operate in states between fully open and fully closed, such that the control circuit can command the ball valves to open to an optimal position for conserving water based on the temperatures measured from the temperature sensors.

17. A method of using the automatic fluid spray system of claim 1, the method comprising: starting the water pump while the valve is in a closed position to permit fluid to return to the fluid source but not enter the spray line.

* * * * *